US008322896B2

(12) United States Patent
Falicoff et al.

(10) Patent No.: US 8,322,896 B2
(45) Date of Patent: Dec. 4, 2012

(54) SOLID-STATE LIGHT BULB

(75) Inventors: Waqidi Falicoff, Stevenson Ranch, CA (US); Yupin Sun, Yorba Linda, CA (US)

(73) Assignee: Light Prescriptions Innovators, LLC, Altadena, CA (US)

( * ) Notice: Subject to any disclaimer, the term of this patent is extended or adjusted under 35 U.S.C. 154(b) by 189 days.

(21) Appl. No.: 12/910,511

(22) Filed: Oct. 22, 2010

(65) Prior Publication Data

US 2011/0095686 A1 Apr. 28, 2011

Related U.S. Application Data

(60) Provisional application No. 61/279,586, filed on Oct. 22, 2009, provisional application No. 61/280,856, filed on Nov. 10, 2009, provisional application No. 61/299,601, filed on Jan. 29, 2010, provisional application No. 61/333,929, filed on May 12, 2010, provisional application No. 61/264,328, filed on Nov. 25, 2009.

(51) Int. Cl.
*F21S 13/10* (2006.01)

(52) U.S. Cl. ..... 362/363; 362/311.06; 362/249.01; 362/249.02; 313/512; 313/46

(58) Field of Classification Search ..... 313/110, 313/512, 46; 362/111, 296.08, 311.01–14, 362/363, 249.01–2; 257/98–100
See application file for complete search history.

(56) References Cited

U.S. PATENT DOCUMENTS

| | | | | |
|---|---|---|---|---|
| 6,161,910 | A | 12/2000 | Reisenauer et al. | |
| 6,635,987 | B1 | 10/2003 | Wojnarowski et al. | 313/498 |
| 7,040,776 | B2 | 5/2006 | Harrell et al. | |
| 7,347,599 | B2 | 3/2008 | Minano et al. | 362/511 |
| 7,350,936 | B2 | 4/2008 | Ducharme et al. | 362/231 |
| 7,479,662 | B2 | 1/2009 | Soules et al. | 257/98 |
| 7,600,882 | B1 | 10/2009 | Morejon et al. | 362/84 |
| 7,663,315 | B1 * | 2/2010 | Hulse | 313/512 |
| 7,915,627 | B2 | 3/2011 | Li | |
| 2005/0068776 | A1 | 3/2005 | Ge | |
| 2005/0259419 | A1 * | 11/2005 | Sandoval | 362/249 |

(Continued)

FOREIGN PATENT DOCUMENTS

JP 2008-186758 A 8/2008

(Continued)

OTHER PUBLICATIONS

N. Narendran, Y. Gu, J.P. Freyssinier-Nova, Y. Zhu, *Extracting phosphor-scattered photons to improve white LED efficiency*,—phys. Stat. sol. (a), vol. 202, No. 6, R 60-R 62 May 2005.

(Continued)

*Primary Examiner* — Mary Ellen Bowman

(74) *Attorney, Agent, or Firm* — Drinker Biddle & Reath LLP

(57) ABSTRACT

An example of this light bulb has a light emitting element (which may be an LED array) mounted on a circuit board. The circuit board is mounted on one end of a heat-conducting frame. An Edison screw or other suitable connector, for attaching the light bulb electrically and mechanically to a receptacle, is mounted on the other end of the frame. A transparent phosphor-coated ball has a flat chord face optically bonded to said array. A light-permeable globular enclosure is mounted on the frame, surrounding the ball and both homogenizing the white light output of the bulb but also concealing the yellowing unlit appearance of the remote phosphor ball centrally located within it.

22 Claims, 10 Drawing Sheets

U.S. PATENT DOCUMENTS

| | | | | |
|---|---|---|---|---|
| 2007/0018181 | A1 | 1/2007 | Steen et al. | 257/98 |
| 2007/0081336 | A1 | 4/2007 | Bierhuizen et al. | 362/293 |
| 2007/0120135 | A1 | 5/2007 | Soules et al. | |
| 2008/0030993 | A1 | 2/2008 | Narendran et al. | 362/296 |
| 2008/0054281 | A1 | 3/2008 | Narendran et al. | 257/98 |
| 2008/0117500 | A1 | 5/2008 | Narendran et al. | 359/326 |
| 2008/0299398 | A1* | 12/2008 | Hata et al. | 428/412 |
| 2009/0052186 | A1* | 2/2009 | Xue | 362/294 |
| 2009/0067179 | A1 | 3/2009 | Chaves et al. | 362/329 |
| 2009/0225529 | A1 | 9/2009 | Falicoff et al. | 362/84 |

FOREIGN PATENT DOCUMENTS

| | | | |
|---|---|---|---|
| KR | 10-2001-0069867 | A | 7/2001 |
| KR | 10-2005-0046742 | A | 5/2005 |
| KR | 10-2006-0117612 | A | 11/2006 |
| KR | 20-2008-0006566 | U | 12/2008 |

OTHER PUBLICATIONS

Anonymous, ip.Com Technical Disclosure No. IPCOM000176079D, *Remote Reflective Phosphor Lighting Device*, Nov. 4, 2008.

International Search Report and Written Opinion for PCT/US2010/053748.

International Search Report and Written Opinion for PCT/US2010/053758.

A.A. Bergh and P.J. Dean, "Light Emitting Diodes", Clarendon Press, Oxford, 1976, p. 350, Fig. 4.4.

L.F. Johnson et al., Infrared-to-Visible Conversion by Rare-Earth Ions in Crystals, J. Appl. Phys., vol. 43, No. 3, Mar. 1972, p. 1133, Fig. 15.

* cited by examiner

SOLID-STATE LIGHT BULB

CROSS REFERENCE TO RELATED APPLICATIONS

This application claims benefit of: U.S. Provisional Application 61/279,586 filed Oct. 22, 2009 titled "Lamp" by several of the inventors; U.S. Provisional Patent Application 61/280,856, filed Nov. 10, 2009, U.S. Provisional Patent Application 61/299,601, filed Jan. 29, 2010, and U.S. Provisional Patent Application 61/333,929 filed May 12, 2010, all titled "Solid-State Light Bulb With Interior Volume for Electronics," all by some of the same inventors; and U.S. Provisional Application 61/264,328 filed Nov. 25, 2009 titled "On-Window Solar-Cell Heat-Spreader" by several of the inventors. All of those applications are incorporated herein by reference in their entirety.

Reference is made to co-pending and commonly owned U.S. patent application Ser. No. 12/378,666 (publication no. 2009/0225529) titled "Spherically Emitting Remote Phosphor" by Falicoff et al., Ser. No. 12/210,096 (publication no. 2009/0067179) titled "Optical Device For LED-Based Lamp" by Chaves et al, and Ser. No. 12/387,341 (publication no. 2010/0110676) titled "remote phosphor LED downlight." All of those applications, which have at least one common inventor to the present application, are incorporated herein by reference in their entirety. Reference is made to co-pending U.S. patent application Ser. No. 12/778,231 titled "Dimmable LED Lamp," filed May 12, 2010, Ser. No. 12/589,071 (publication no. 2010-0097002), titled "Quantum Dimming via Sequential Stepped Modulation" filed Oct. 16, 2009, and Ser. No. 12/910,532, titled "Remote phosphor light engines and lamps," filed Oct. 22, 2010, all by several of the inventors. All of those applications, which have at least one common inventor to the present application, are incorporated herein by reference in their entirety.

BACKGROUND OF THE INVENTION

As disclosed in several previous applications including the above-mentioned U.S. Ser. No. 12/378,666 and U.S. Ser. No. 12/210,096, a spherical remote phosphor can have very uniform luminance, and thereby a uniform spherical intensity. Phosphor-LED light systems typically use blue LEDs and a yellowish phosphor, which combine to produce a white light. An aesthetic drawback of a large spherical remote phosphor in some cultures and contexts, however, is its strongly yellowish appearance when the lamp is unlit and no blue light is present. A further aesthetic drawback is that the shape of the remote phosphor lamp is usually substantially different from that of conventional light bulbs, with their sphere-on-a-threaded-stalk look. What is needed is an LED lamp with the same shape as a traditional incandescent bulb, but with adequate heat-removal capability for efficient use of LEDs and phosphors, especially when tasked to produce the same high luminosity as a 75-Watt incandescent bulb, at far lower power.

The prior art includes U.S. Pat. No. 7,479,662 to Soules, et al., which discloses a transparent sphere with a blue LED chip at its center and a phosphor coating on its surface. FIG. 4 in Soules shows an LED chip 312 mounted in the center of a molded sphere 318 which has a "phosphor layer . . . coated on the inside surface of the sphere." Soules states that the LED "will radiate uniformly in all directions". However, Soules does not provide details of the LED that will achieve that uniform spherical light distribution. Commonly available LEDs typically produce a hemispherical (or near hemispherical) Lambertian intensity pattern, which is well known to be quite non-uniform. There are also some LEDs with batwing or other non-uniform intensity patterns, but none with hemispheric uniformity. Instead, the hemispherical Lambertian output of a typical packaged LED or chip gives a non-uniform distribution of blue light onto the phosphor coating in a hemisphere (only half a sphere), resulting in non-uniform surface chrominance, with the highest color temperature above the chip and the lowest behind it.

In the embodiment shown in FIG. 4 of Soules, if LED chip 312 does not emit spherically (as is required by Soules) but is a hemispherical Lambertian source, then the upper hemisphere of the phosphor coated inner surface of the hollow ball will be directly lit by blue light striking it from the LED. The lower hemisphere of the phosphor coated surface cannot be lit directly but is lit only by the meager blue light reflected from the upper hemisphere.

Measurements done by the inventors and other researchers in the field of remote phosphor LED light sources (e.g. N. Narendran, Y. Gu, J. P. Freysinnier-Nova, Y. Zhu, "Extracting phosphor-scattered photons to improve white LED efficiency", Phys. Stat. Sol. (a) 202 (6): R60-R62, Rapid Research Letters, 2005 Wiley-WVH, see FIG. 3) show that typically the percent of reflected blue light from a transmissive phosphor layer designed to produce white light is around 10 to 15%, largely independently of the density of the phosphor coating (see FIG. 3 of Narendran et al). That is to say, 85 to 90% of the blue light will either be converted or pass unconverted through the phosphor layer on the upper hemisphere. Approximately 40 to 50% of the converted yellow light from the upper hemisphere will be emitted inwardly (see FIG. 3 of Narendran et al) and travel toward the lower hemisphere. In order for the white light ultimately emitted from the bulb to be the same on both hemispheres (same intensity, color temperature, etc) the amounts of yellow and blue light (and their ratio) must match the upper hemisphere at all points on the sphere. This presumably is possible somehow, but with an LED at the center of the sphere it is not obvious how this can be accomplished as is described by Soules et al. There is an additional problem to be overcome as a consequence of the non-uniformity of the light striking the different vertically located zones of the phosphor, light radiated non-uniformly from the Lambertian emitting LED. The intensity from a Lambertian source varies as a function of the cosine of the angle away from normal the ray is emitted. The intensity of any Lambertian surface drops to zero when the ray is perpendicular to the normal, precisely because it is parallel to the plane of the source. Therefore, the system of FIG. 4 of Soules would be unable to achieve uniform white light using LEDs that have a Lambertian output. This presumably is why Soules states that his system operates with LEDs that produce "uniform" output.

Soules in his FIG. 2 shows a more practical embodiment of his invention, one with a hemispherical remote-phosphor cover. That overcomes the problem stated previously in the embodiment of his FIG. 4, as it eliminates the lower-hemispheric section. Soules does not, however, address the paramount issue of the Lambertian output of typical LEDs and presumably relies on the LED to somehow produce "uniform" light in all angular directions within the upper hemisphere.

SUMMARY OF THE INVENTION

It would be desirable to have a remote phosphor solid state light source that produces spherical uniform light, or light with a similar output distribution to that of a traditional incandescent lamp, while utilizing standard LEDs, either singly or in an array, in spite of their being hemispherical Lambertian emitters. One non-remote phosphor approach that has been tried is to mount white LEDs onto a cylindrical metal core mounted at the end of a rod, as exemplified by the Dynasty S14 lamp of CAO Group, Inc. of Utah. This lamp, however, and others in their product line produces a butterfly beam pattern as opposed to the more desirable spherical one.

Another approach that could be used is to put white LEDs onto a spherical metal ball. The rod on which the ball is mounted, however, must be considerably narrower than the diameter of the ball, if it is not to block out too much of a solid angle. The rod provides the principal cooling pathway for the ball. That configuration, however, tends to have cooling problems because of the restricted size of the thermal pathway relative to the energy density on the surface of the spherical ball. Secondly, there are dark zones because the LED sources cannot be mounted so as to fully populate a sphere, using square die or existing packaged LEDs. Theoretically, the phosphor could be deposited over an array of small chips including the dark zones around the chip. However, that arrangement results in a beam with visibly different color temperatures in different directions, something found unaesthetic. Also, placement of the chips onto a spherical shape is difficult, and does not lend itself to volume production techniques that typically use pick and place machines.

It would be desirable to have a solid state light source using remote phosphor with similar angular distribution to the nearly spherical luminosity distribution of a 75 W type A19 incandescent bulb, one with the same geometric constraints but with far higher efficacy. Embodiments of the present invention meet, at least in part, these and other requirements.

LEDs are sensitive to over-temperature conditions. Therefore, in order to provide a thermally viable LED light-bulb design, it is desirable for the heat load from the chips to be removed with a sufficiently low thermal resistance (in ° C./Watt) for a safe operating temperature. The heat is found by subtracting the total radiant output power from the electrical input power. Specifying an upper safe temperature and an upper ambient temperature gives the minimum temperature difference, which is divided by the Watts of heat to give the thermal resistance.

It is also desirable to provide a lamp that can be operated in a conventional light-bulb receptacle. Such a receptacle is typically provided with power at 110-120 or 220-240 volts, 50 or 60 Hz AC, depending on the country. An LED, however, typically requires only about 3 volts DC. An array of LEDs can be wired in series to increase the effective supply voltage, but usually not to 240 volts. It is therefore desirable to provide space within the opaque base of the light-bulb for a power supply unit for AC to DC and voltage conversion. It is also desirable to provide further interior room for such electronic controls as dimming, color-temperature adjustment, and monitoring of chip temperature. It is an objective of the geometry of the embodiments of the present invention to fulfill these objectives.

The remote-phosphor approach of embodiments of the present invention reduces chip heat load as compared to conventional white LEDs, which have the phosphor directly on the chip. For example, a blue chip that radiates 35% of its electrical input as light will have a 65% heat load. A phosphor with 90% quantum efficiency and 80% Stokes efficiency will have a 10% conversion heat load and an 18% heat load from the Stokes shift for a total of 28%. Consider that 85% of the blue light goes into the phosphor and 10% comes out, so that the phosphor heat load is 28% of 75%, or 21%, of all the blue light. For currently available blue chips, the blue light output is 35% of the electrical power. This makes the phosphor heat load be 7% of the electrical power, which is much easier to dissipate by itself from the large phosphor than from the chips, which are already heat-loaded at 65% of the electrical power.

As chip technology improves, more and more of the blue light generated within the active layer is extracted from the chip. Commercial chips of today have already reached 50% efficiency (blue light output of 50% of the electrical power), and the 70-80% range is expected soon. This leaves less and less wasted energy that heats up the chip, allowing higher current levels and greater optical power output for the same heat load. In fact, once the electrodes have been sized for those higher current levels, it can be expected that the only remaining limitation upon current is whatever operating temperature is the highest tolerable. When a high-efficiency blue chip is thus operated at its peak temperature, however, a problem arises with the conventional phosphor geometry of conformal coating. When a chip is, say, 75% efficient, its heat load is only 25% but the phosphor heat load is still 21% of the blue light, which is then 16% of the electrical power. With a conformal phosphor, most of the heat from the phosphor will have to be conducted through the chip, increasing the heat load of the chip by 63% (from 25% electrical to 41% electrical). This means the heat-limited current of a conformally-coated white chip will have to be considerably lower than that of the lone blue chip.

Thermal simulations with a finite element model were carried out by the Inventors utilizing the software package COSMOS. The model assumed there were thermal resistances of 4.24° K/W for the heat sink, 1.85° K/W through the thickness of the blue chip and 100° K/W for the silicone encapsulant layer above the phosphor (the latter being the standard material used in high flux LED packages). It was also assumed that the ambient temperature was 25° C. and the LED and its heat sink were sitting in air with no obstruction impeding convective losses. The following table lists the resultant temperatures.

| Chip efficiency | Current | Blue Alone | Coated Blue | Phosphor |
|---|---|---|---|---|
| 35% | 350 mA | 53° C. | 56° C. | 67° C. |
| 80% | 350 mA | 33° C. | 43° C. | 68° C. |
| 80% | 1340 mA | 60° C. | 89° C. | 180° C. |

The bottom row of the table shows a 29° C. elevation of the operating temperature of a high-amperage blue-chip with a conformal coating compared to one without any phosphor. This temperature elevation would only grow with more amperage, reaching the temperature ceiling of the chip, usually 125° C., much sooner than for the lone blue chip used in embodiments of the present invention. However, in the bottom row of the table the phosphor layer in the conformal coated packaged LED already reaches a temperature of 180° C. Such a high phosphor temperature will significantly reduce the quantum efficiency of the phosphor, adding yet more to the heat load.

Thus one of the advantages of embodiments of the present invention is that they can provide a remote phosphor geometry that prevents these over-temperature problems from arising at all, or substantially mitigates the problems. A further advantage of embodiments of the present invention is that they can operate just as well with a single blue chip as with many blue chips. Once high-efficiency chips have proven out for, say, 3 Amperes, only one chip will be necessary here. The same design can handle one or more chips. Thus, an optical design developed for several presently available chips can easily be adapted to use fewer or a single chip as and when more powerful chips become available. As was previously mentioned, in embodiments of the invention the chips only need to be located on or near the phosphor ball on a slope that is nearly the same as the tangent on its bottom perimeter.

Embodiments of the invention provide a light bulb comprising at least one light emitting element, a circuit board, said at least one light emitting element mounted on said circuit board, a heat-conducting frame, said circuit board mounted on said heat-conducting frame, a connector for attaching the light bulb electrically and mechanically to a receptacle, mounted on an opposite end of said frame from said at least one light emitting element, a transparent ball, said transparent ball coated with a phosphor, said phosphor comprising a material which is photostimulated by said light-emitting element, and an interface surface occupying a minor portion of the surface of said ball, said interface surface optically bonded to said at least one light emitting element.

The at least one light emitting element is preferably mounted close to the ball, and interfaced directly to the ball, in contrast to the devices shown in the above-referenced US Patent Application No. 2009/0225529, in which the light emitting elements are remote from the phosphor-coated ball, and are connected to the ball by a collimator and a concentrator. As is shown in examples below, "close" preferably means that the circuit board is in a range from a position just outside the ball (or the notional continuation of the curve of the ball, if part of the ball is cut off for the interface) in which a light emitting element at the center of the circuit board just touches the curve of the ball to a position inside the curve of the ball cutting off a chord that subtends a half-angle of no more than 30°.

In one embodiment, the front of at least one light emitting element mounted on the circuit board is no further from the center of the transparent ball than 1.1 times the radius of the transparent ball.

In another embodiment, the at least one light emitting element is positioned so that it can illuminate directly (i.e., without any assistance from optical elements other than refraction at the interface) the entire interior of the ball (apart, of course, from any portion omitted at the interface). In some embodiments where the circuit board is flat and the periphery of the circuit board is outside the curve of the ball, a cone frustum reflector may be provided from the periphery of the circuit board tangentially to the ball, but there is then no part of the interior of the ball that is illuminated solely by light from the cone frustum.

The interface surface may be at the front surface of the at least one light emitting element, or at the front surface of an encapsulant applied to the at least one light emitting element. Where the ball is hollow, the interface surface may be an interface between the encapsulant and the air within the ball. Where the ball is solid, the interface surface may be an interface between the encapsulant and the material of which the ball is made, and may be formed with an index-matching or other bonding material.

BRIEF DESCRIPTION OF THE DRAWINGS

The above and other aspects, features and advantages of the present invention will be apparent from the following more particular description thereof, presented in conjunction with the following drawings wherein.

DETAILED DESCRIPTION OF THE PREFERRED EMBODIMENTS

A better understanding of various features and advantages of the present invention may be obtained by reference to the following detailed description and accompanying drawings, which set forth illustrative embodiments in which certain principles of the invention are utilized.

Figure 1A:
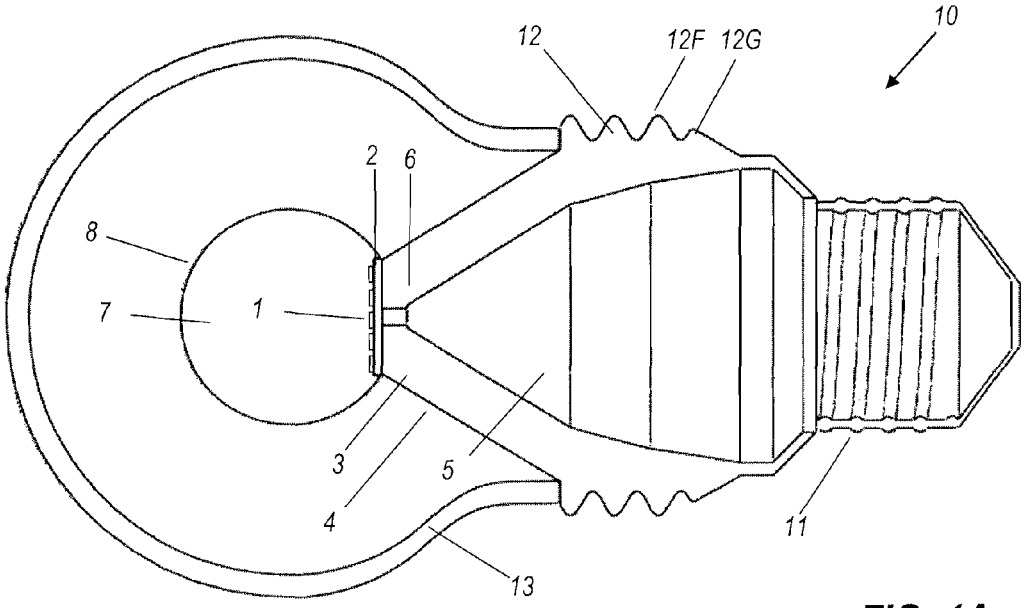
FIG. 1A is a cross-sectional view of an embodiment of the LED light bulb.
Figure 1B:
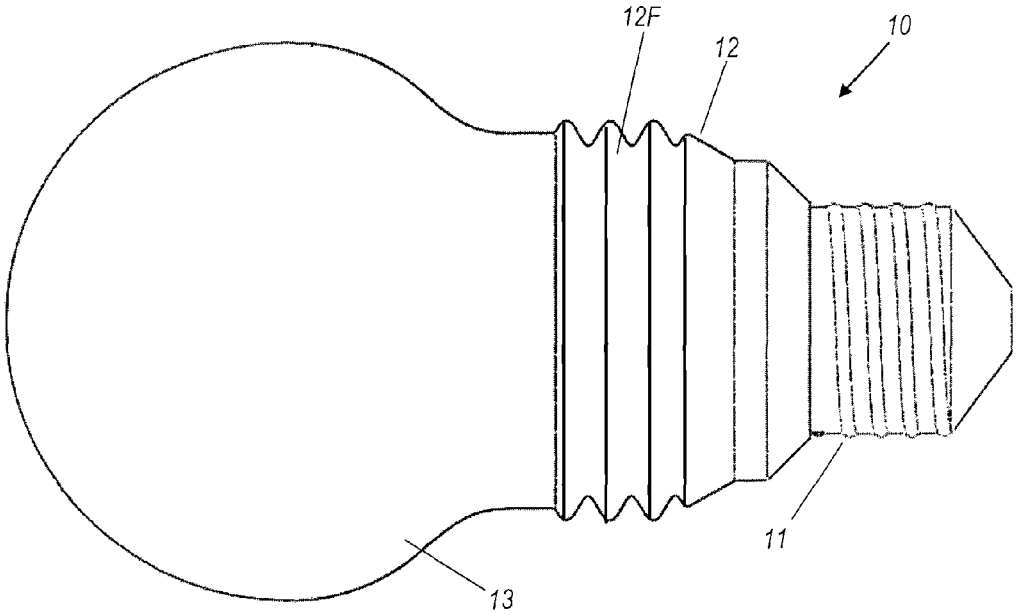
FIG. 1B is an external view of the bulb shown in FIG. 1A.

Referring to the drawings, and initially to FIGS. 1A and 1B (collectively FIG. 1), one embodiment of an LED light bulb 10 comprises an array 1 of blue LED chips mounted upon circuit board 2. Circuit board 2 is in turn mounted upon thermally conducting frame 3. The front part of conductive frame 3 is a cone frustum, with the circuit board 2 mounted on the flat top of the frustum. The conical exterior surface 4 of the conical part of conducting frame 3 is diffusely reflective (white). Frame 3 encloses an interior space 5 that contains power and control circuitry (not shown in detail) for the LED light engine (i.e., LED array 1 and circuit board 2). A transparent ball 7 is optically coupled to LED array 1 (i.e., with no air gap between them). The transparent ball 7 has a flat face forming a chord cutting off a minor segment of the ball, and it is the flat face that is coupled to the LED array 1. A phosphor coating 8 is applied on the spherical exterior of transparent ball 7, and thus is fairly uniformly illuminated by array 1, due to the array being a chord of the sphere, as will be explained below with reference to FIG. 3B. In FIG. 1A, a hollow external envelope 13 encloses ball 7 and the conical part of frame 3, and attaches to external surface 12 of frame 3 at the base of the conical part. Thus, the diffuse white coating on surface 4 covers the part of frame 3 that is exposed within envelope 13.

FIG. 1A further shows that thermally conducting frame 3 conducts heat from the LEDs 1 and the phosphor-coated ball 7 away to the part of frame 3 behind envelope 13, which is exposed to the surrounding atmosphere, so that the heat can be dissipated thereto. Cooling fins 12F may be formed on the exposed part of frame 3. Cooling is further enhanced because a significant part of the heat from phosphor coating 8 is dissipated by radiation and convection to outer envelope 13. Edison screw 11 (or alternatively any other appropriate connector) attaches to the back end of frame 3.

As shown by thermal simulations of the preferred embodiment of FIG. 1A, the greater surface area for heat transfer of fins 12F results in a 7° C. lower junction temperature of the LEDs 1, as compared to an otherwise similar bulb with a smooth surface (no features). A preferred embodiment of fins 12F is a sinusoidal configuration with a pitch of approximately 5.8 mm, with amplitude of 3 mm. FIG. 1A shows in cross-sectional view one form of this preferred embodiment, in which there are three fins 12F with an overall projected height (peak-to-peak amplitude) of 3 mm and a fourth fin 12G with a projected height of 1.5 mm. Other fin configurations are possible, including ones based on a spiral pattern. The fins can also serve a decorative function, camouflaging the frame 3, which is rather more bulky than a conventional incandescent light bulb, in order to maximize interior space 5.

FIG. 1B shows an external view of LED light bulb 10, with Edison screw connector 11, frame 12 (acting as a heat sink with fins 12F), and translucent globe 13. Because globe 13 is translucent, and not transparent, the phosphor-coated ball 8, light engine (LED array 1 on circuit board 2), and the front end of the frame 3 are all effectively concealed, presenting an external appearance very similar to a conventional frosted glass incandescent bulb.

Figure 2A:
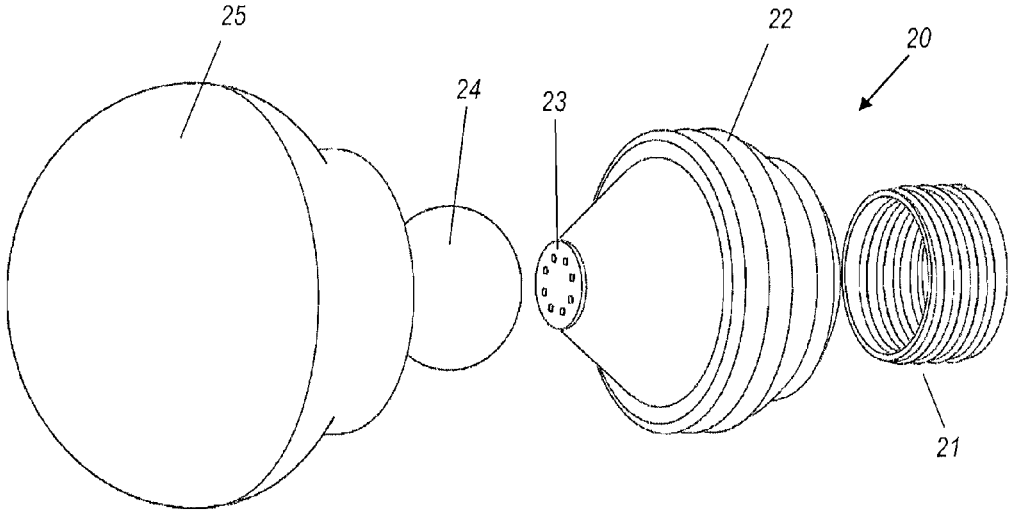
FIG. 2A is an exploded view of the bulb of FIG. 1A, seen obliquely from the front or bulb end.
Figure 2B:
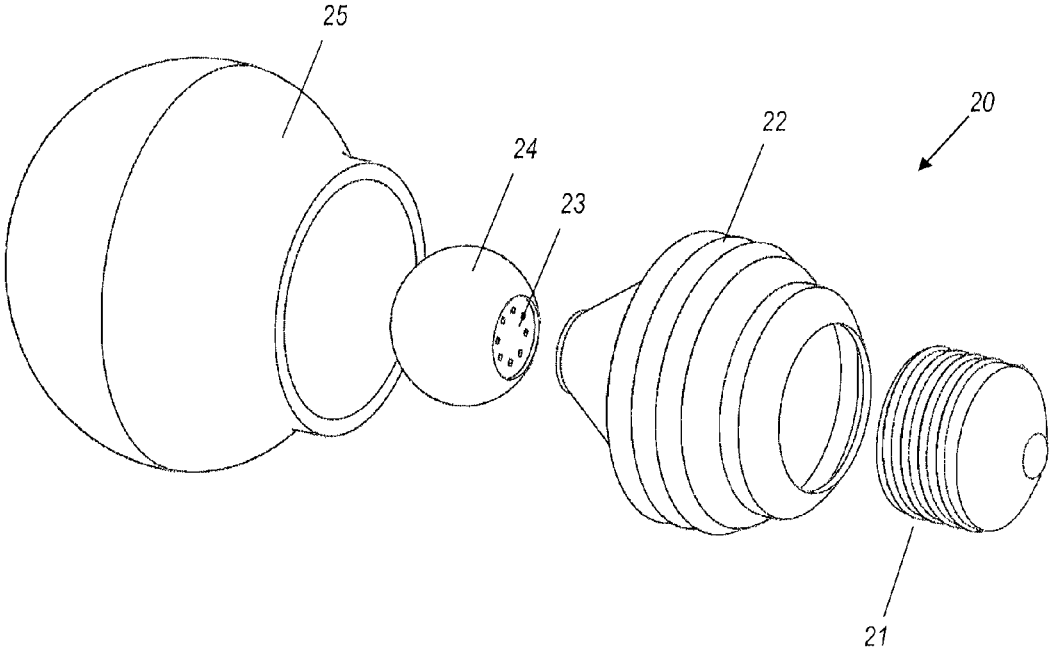
FIG. 2B is a view similar to FIG. 2A, but obliquely from the rear or screw end.

FIG. 2A and FIG. 2B (collectively FIG. 2) show two exploded views of LED light bulb 10, with Edison socket 11, heat-sinking frame 3, light engine 1, 2 (i.e., LED array and circuit board, as in FIG. 1), phosphor-coated ball 7, 8, and translucent globular enclosure 13. FIG. 2A shows light engine 1, 2 in place with the LEDs facing phosphor-coated ball 7. In FIG. 2B the LEDs are exploded from their circuit board so they are visible from behind, and are shown in their assembled positions relative to the phosphor-coated ball 7. The LEDs can either be bare chips or be packaged. In the first case they can be imbedded in a suitable encapsulant which is also in contact with dielectric substrate of phosphor ball 7. In the case of the packaged LEDs the interior of phosphor ball 7 can be hollow or filled with encapsulant as needed. Suitable materials for the encapsulant are silicones and epoxy, from companies such as Nusil, Nye Optical and Dow Corning, all in the US, and Shin-Etsu Silicone of Japan. The translucence of enclosure 13 assures a pleasing diffuse luminance that is uniform over its whole surface. The white surface 4 of FIG. 1 helps with this uniformity. The translucence of enclosure 13 also conceals the yellow appearance of the phosphor coating 8 on ball 7 when the light is off. The concealment of the spherically shaped phosphor coating, within a frosted bulb resembling a conventional incandescent bulb, eliminates or greatly reduces the aesthetic issues hindering commercial acceptance of some previous remote-phosphor LED light bulbs in some markets.

To assist in understanding the relationship of the parts, the light engine 1, 2 is shown on the tip of heat-sinking frame 3 in FIG. 2A, and seated on the chord face of ball 7 in FIG. 2B. In the assembled lamp, the three components fit together so that the light engine 1, 2 has the illustrated relationships to both the frame 3 and the ball 7.

Figure 3A:
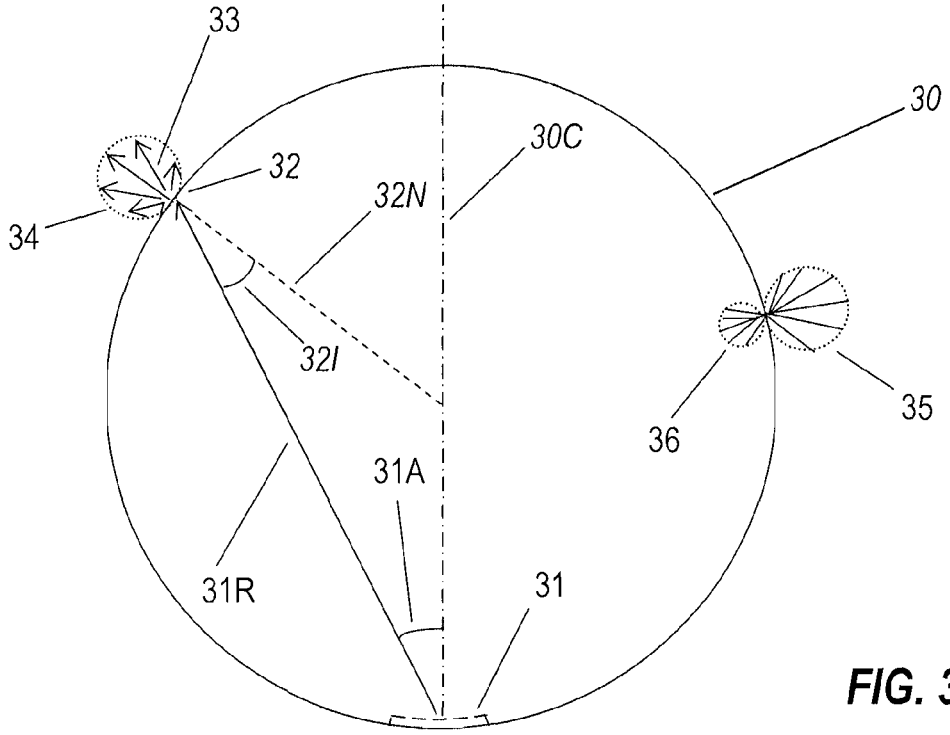
FIG. 3A is a diagram of the interior geometry of a sphere.

FIG. 3A is a cross-sectional view of sphere 30 with a transparent interior, which can either be filled with a transparent dielectric material or be a hollow sphere with a thin transparent outer surface. The outer wall of sphere 30 has a Lambertian scattering surface. Centerline 30C goes through small light source 31, which emits exemplary ray 31R at angle 31A from the surface normal, as defined by centerline 30C. Ray 31R intersects the sphere interior at point 32, at local incidence angle 32I with local normal 32N (i.e., the radius). Incidence angle 32I necessarily equals angle 31A, a value in degrees hereinafter designated θ. Ray 31R is scattered by the sphere surface at point 32, into diffusely transmitted light 33, which has the same Lambertian pattern, designated by dotted circle 34, no matter from what angle the surface is illuminated. This is the definition of complete optical diffusion: the erasure of incoming directional information by its conversion into Lambertian scattering.

For a sphere of radius R (the length of dotted line 32N of FIG. 3A), diameter D=2R, and for ray incidence angle θ, the length of ray 31R is r=D cos θ. If light source 31 has area A and radiates light with surface luminance L, then its on-axis intensity is $I_0=L/\pi A$. For a Lambertian source, at off-axis angle θ the intensity is $I=I_0 \cos\theta$. Allowing for the oblique angle of incidence (32I=θ) at point 32 the illuminance is given by $i=I \cos\theta/r^2=I_0/D^2$, which is independent of θ and hence of the location of point 32. This is the principle used by all integrating spheres to assure a homogeneous and isotropic light field within. This principle also assures that a translucent sphere illuminated from anywhere on its interior surface will have a uniform brightness. Dotted circle 35 of FIG. 3A denotes the Lambertian emission of transmitted light as being the same as for that of circle 34, but there is also smaller dotted circle 36 denoting the Lambertian emission of diffusely reflected light. This is the reflected light back-radiated from the phosphor. A smaller circle similar to circle 36 could also be associated with circle 34, but for the sake of clarity is not shown. While a smooth surface, such as that of a holographic diffuser, spectrally reflects only a few percent, the typical surface diffuser also reflects, at some greater amount than this, but the reflected light is not specular. This backscattering, as illustrated by circle 36, further homogenizes the light field within the sphere. When light source 31 emits blue light and the sphere comprises a photostimulated phosphor, its illumination will be highly uniform, and thus so will its luminance.

Figure 3B:
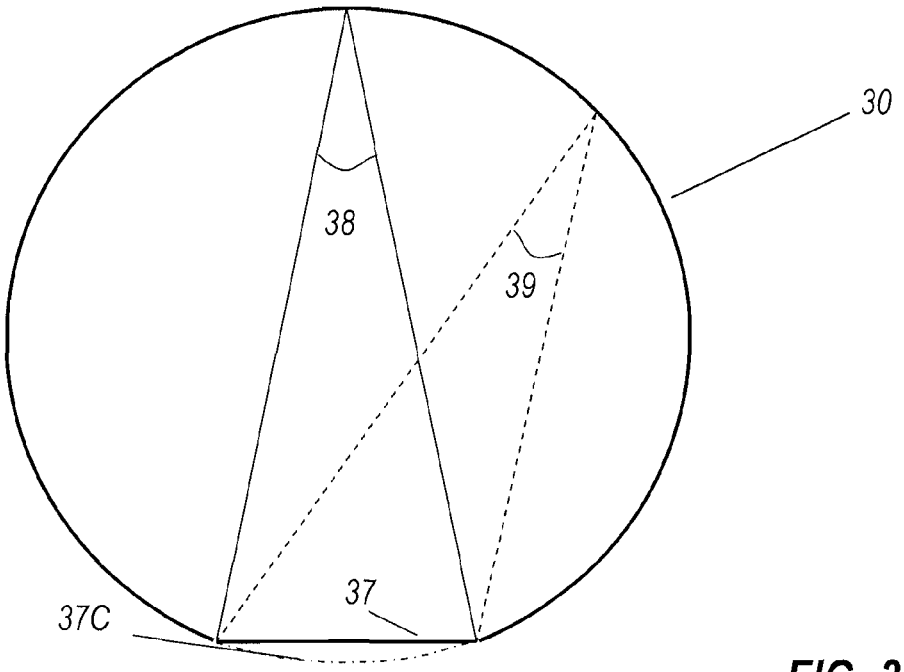
FIG. 3B is a diagram of the interior geometry of a portion of a sphere with a disk at its base.
Figure 4A:
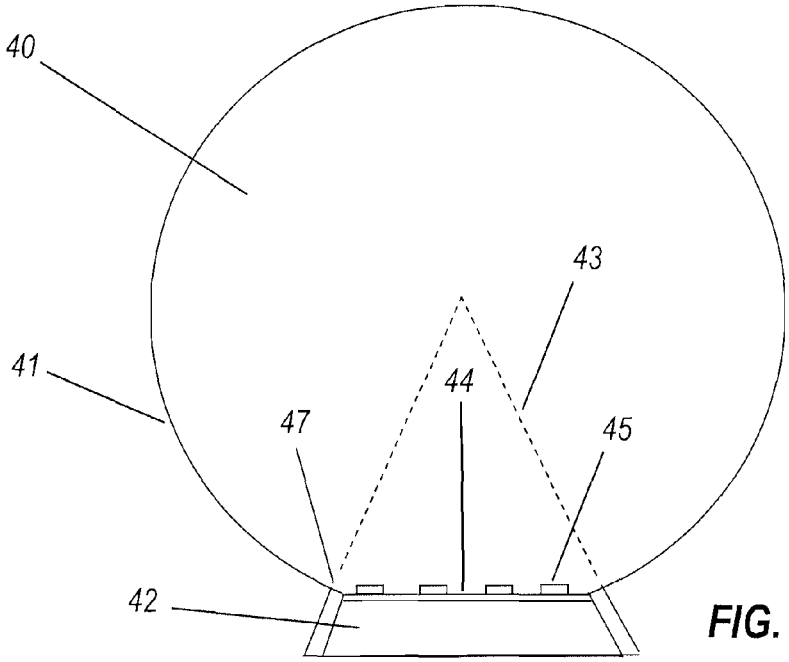
FIG. 4A is a close-up cross-sectional side view of the light engine and spherical phosphor of the bulb shown in FIG. 1A.

FIG. 3B shows another view of sphere 30 with chord 37 at its base. There is a very useful property of a circle with respect to the two end points of any chord. Geometry teaches that the angle subtended at any point on the circle with respect to the two edge points is the same for all points on the circle (except the two end points of the chord). This is exemplified by angles 38 (solid lines) and 39 (dashed lines), which are equal. This 2-dimensional relationship can be extended to the case of a sphere when the chord is replaced by a circular disk, as long as its boundary is on the sphere, and when the angles are replaced with projected solid angles (i.e., solid angles reduced by their slant). That is to say, all the projected solid angles of the disk are the same at any point on the sphere surface. This holds for any circular disk the boundary of which coincides with the sphere. In addition, there is a principle of illumination engineering known as the law of equivalence. This principle permits us to say that any two Lambertian sources that subtend the same solid angle at the vertex of the solid angle will produce the same illuminance at that vertex point. Below chord 37 of FIG. 3B there is a dotted circular line 37C that is a continuation of sphere 30. If this dotted line represents a Lambertian source then the law of equivalence permits us to say that this source will produce the same illuminance on sphere 30 as a circular Lambertian disk source (of the same luminance) having the same circular boundary as the spherical section. That holds true for any circular disk with its boundary on sphere 30, even one bisecting that sphere. FIG. 4A shows a preferred embodiment that makes use of that fact.

FIG. 4A is a close-up cross-sectional view (not drawn to scale) corresponding to a portion of FIG. 1A (which is drawn to the scale of one preferred embodiment). Transparent ball 40 is spherical, and has spherical phosphor coating 41 on its exterior surface. The ball is slightly truncated by circuit board 44, which rests on base 42. For a preferred embodiment of this invention the circuit board 44 spans a chord of the spherical ball 40 of ±15° to ±30° (the higher figure being the value for the preferred embodiment of FIG. 1A). That is to say, the circuit board 44 of FIG. 4A is the base of an imaginary cone 43 of 15° to 30° half angle with its apex at the center of the ball 40. On the board is shown a multi-tiered circular array 45 of blue LEDs, illuminating coating 41 from within, to nearly complete uniformity, unlike the case with angles not much larger, such as 45°. A further benefit of this ±30° limit is that base 42 only blocks half the rearward light from coating 41. The importance of a small limiting angle can be seen in a ball's reduced intensity in lateral and rearward directions when a 45° half angle is utilized instead.

In another embodiment, the maximum spacing from the underside of circuit board 44 to the notional continuation of sphere 41 is no more than 10% of the radius of sphere 41. With a circuit board 44 of typical thickness, this corresponds to a cone 43 of approximately 30° half angle, with its apex at the center of sphere 41 and its base on the circle that is the intersection of the top side of circuit board 44 with sphere 41.

Figure 4B:
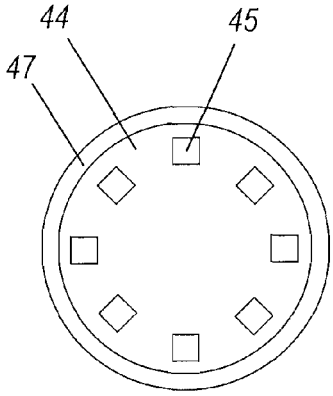
FIG. 4B is a plan view of the light engine in FIG. 4A.

FIG. 4B is a front or plan view showing circuit board 44, circular array 45 of blue LEDs, and diffuse reflector 47. There are several configurations for array 45 that can achieve high uniformity without resorting to the very difficult task of populating the entire surface of circuit board 44 with LEDs. It can be shown by analytical equations and ray tracing (both approaches have been done by the Inventors) that a ring of LEDs near the edge of the circuit board 44 will achieve high uniformity if a sufficient number (such as eight or more) of LEDs is placed on the ring. A preferred embodiment based on a circuit board radius of 7 mm has at least eight blue LEDs on the outer ring, one every 45°.

In this and other preferred embodiments, it is desirable to have circuit board 44 made of, or covered with, diffuse highly reflective material. Also, a small ring section 47 of the bottom of sphere 40, immediately surrounding circuit board 42, can be a white diffuse reflector. Ray-trace modeling by the Inventors showed that if a 10-15° zone of the bottom of sphere 42 is a diffuse reflector, any further improvement in uniformity would be slight, as well as unnecessary to achieve the standards for most commercial or residential lighting applications. The Next Generation Lighting Industry Alliance (NGLIA) is a consortium including some of the largest lamp manufacturers in the world. The latest proposal by the NGLIA to the US Department of Energy (DOE) was in response to a request by the DOE relating to the US DOE Energy Star regulations (not yet enacted into law). It provides some guidelines for new lighting solid state sources to meet. For omni-directional replacement lamps, the NGLIA proposes a variation in intensity of less than ±25% from the mean intensity for the angles 0-125° (where 0° is the axial direction away from the screw end of the bulb, towards the direction referred to in this specification as the "front"). Ray-tracing by the Inventors shows that a preferred embodiment based on the proportions shown in FIG. 4A, with eight blue LEDs (every 45°) achieves uniformity better than ±12.5% over this angular range (as can be seen in the iso-candela plot of FIG. 8).

Figure 5:
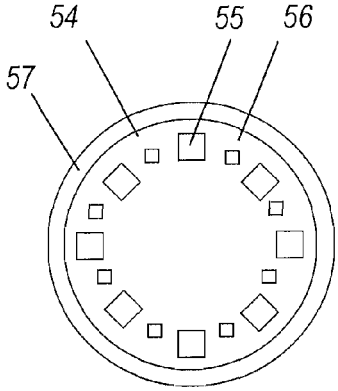
FIG. 5 is a plan view of a light engine similar to that shown in FIG. 4B, but with both blue and red LEDs.

LED arrays can also include other colors of LEDs in conjunction with the blue LEDs. A high CRI can be obtained, for example, if there are some red LEDs as well. FIG. 5 shows LED array 55 with eight blue LEDs interspersed with LED array 56 with eight red LEDs. This arrangement works well with several currently commercially available blue LED chips from the CREE Corporation of North Carolina, U.S.A., and red chips from OSRAM OPTO SEMI of Germany. Appropriate phosphor materials for such a system to achieve high efficacy and CRI are available from Intematix of California and PhosphorTech of Georgia, U.S.A. Further details concerning the ideal ratios for the blue and red LEDs are given in the above-mentioned U.S. application Ser. Nos. 12/589,071 and 12/778,231.

When red LEDs are used as shown in FIG. 5, at least eight more are needed interspersed between the blue LEDs, for a total of at least 16 LEDs (every 22.5°), when using the above mentioned commercially available LEDs. As the circumference is approximately 44 mm, and assuming the chips are each 1 mm square, then there is space of just over 2 mm between each chip. If smaller red chips, such as 0.5 mm square, are used, the number of reds can be doubled, such that two reds are between each two adjacent blue chips (see blue LEDs 76 and red LEDs 77 in FIG. 7B). This can be advantageous because smaller chips have inherently greater efficacy and easier heat removal per Watt generated.

Figure 6:
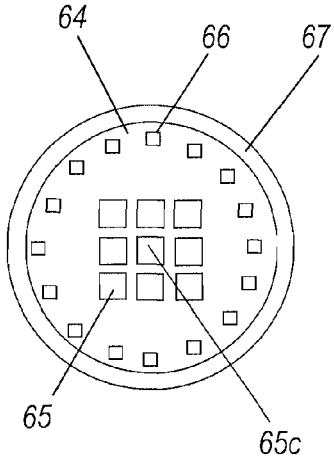
FIG. 6 is a plan view of an alternative arrangement of a light engine with both blue and red LEDs.

FIG. 6 shows circuit board 64 with sixteen red chips 66 placed on the outer ring and the central portion of circuit board 64 populated with blue chips 65 (with a nine count for the convenience of a 3×3 array). That aids in the cooling of the red chips because they are closer to ambient. This is desirable because the direction of heat flow is typically from the LED chips towards the periphery of the circuit board (see, for example, the heat flow in conducting frame 3 of FIG. 1A), resulting in a higher junction temperature for the LEDs placed away from the periphery. Currently available red LEDs are less efficient than currently available blue LEDs at the same elevated junction temperature, so it is beneficial to place the blue LEDs, rather than the red LEDs, at the hottest part of the array.

Figure 11A:
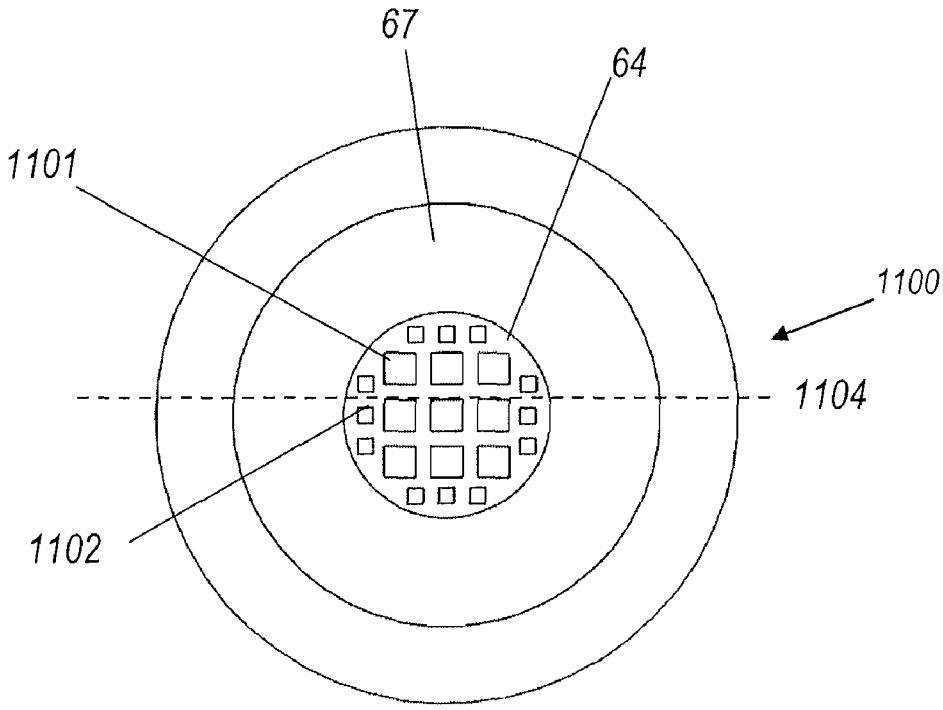
FIG. 11A shows a plan view of an alternative LED configuration for the LED light bulb of FIG. 1.
Figure 11B:
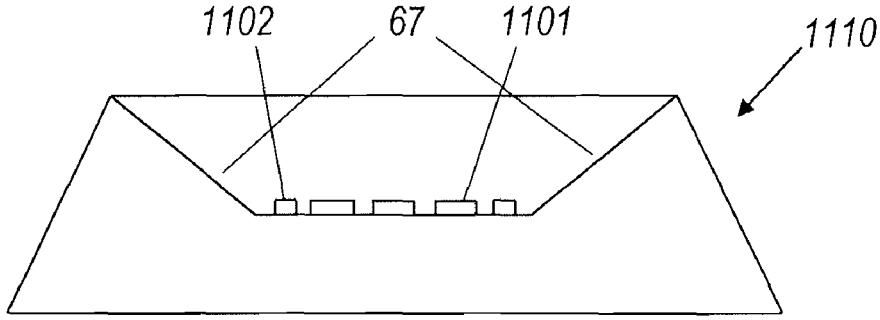
FIG. 11B shows a sectional view of the same with a side reflector.

A ray trace was carried out by the inventors for this configuration, where 9 blue chips 65 (1 mm square with a spacing of 0.5 mm) are located centrally on circuit board 64, which was assumed to have a diameter of 6.6 mm. It was determined that when the inner surface of the phosphor ball is illuminated by light from the blue LEDs (first pass, no recycling) it achieves a contrast (ratio of maximum to minimum intensity) of 1.05 to 1, an excellent result. In this model it is assumed that reflector 67 is a white diffuse reflector. However, if reflector 67 is specular then the uniformity is no longer acceptable, having a value of 1.4 to 1. A study was also carried out to see how close the red LEDs must be located with respect to the outer boundary of circuit board 64 to achieve high uniformity of illumination of the phosphor sphere. FIG. 11A shows a plan view of a light engine 1100 of this configuration where twelve red LEDs 1102 are placed just outside a 3×3 array of blue LEDs 1101. Red LEDs 1102 are arranged with four-fold symmetry. In this case the full opening angle of the outer boundary of circuit board 64 with respect to the phosphor ball is 28°. FIG. 11B shows a section view 1110 of the embodiment of FIG. 11A, taken along the dashed line 1104 of FIG.

11A. Diffuse reflector 67 in FIG. 11B has an opening angle (corresponding to the full angle of cone 43 in FIG. 4A) of approximately 55° with respect to the phosphor ball and is conical in shape as opposed to spherical.

Figure 11C:
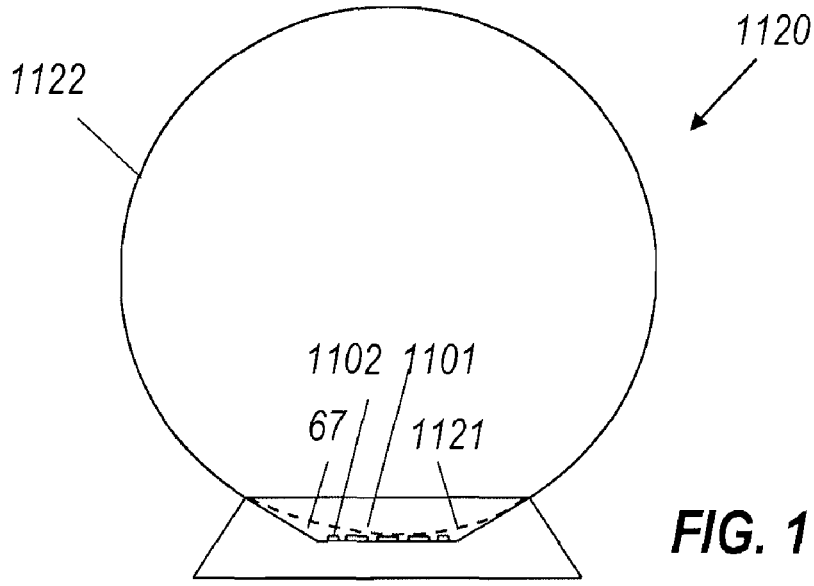
FIG. 11C shows a sectional view of the same with a side reflector and phosphor ball.

In the embodiment of FIGS. 11A and 11B, some of the LEDs are located slightly below the imaginary extension of the sphere defined by phosphor ball, while others are positioned very close to this imaginary sphere. This is illustrated in FIG. 11C, which shows optical system 1120 with spherical phosphor ball 1122, blue LEDs 1101 and red LEDs 1102, configured as in FIGS. 11A and 11B. The outer edge of conical diffuse reflector 67 is seen to be tangent to the edge of spherical phosphor ball 1122. Dashed line 1121 shows the imaginary sphere, which is simply the continuation in space of the spherical surface of phosphor ball 1122 over the part of the sphere where the surface is not physically present. It can be seen how close blue LEDs 1101 are to this imaginary sphere, the central ones being the closest in position and angle. The top of the central blue LED in the 3×3 array is tangent to the sphere. This explains why the uniformity of the blue LEDs is so good (1.05 to 1). Raytracing for the red LEDs shows the uniformity is not as good as the blues with a uniformity of 1.08 to 1. However, this is still acceptable for all but the most stringent lighting applications. The reason for the difference is that the red LEDs are further away from the ideal position.

Also, as the blue LEDs are inside the reds, their tilt is closer to the ideal tilt than that of the reds. The ideal tilt or slope for a source would be that it matches the slope on the point of the sphere that is nearest the position of the source in space. The central blue LED in array 1101 is in the ideal position (touching the sphere) and slope, because it is in the horizontal position, which coincides with the slope of the tangent at that point on the sphere. The outer blues have slightly different slope than the sphere points above them but are close enough to achieve high uniformity. The deviation from the ideal slope is proportional to the cosine of the angle between the normal of the tangent to the sphere at the point nearest to the LED and the normal to the LED surface (assuming the LED is top emitting). As the cosine function changes very slowly from 0° to approximately 10 to 15°, then this explains why the approach works so well. So for example if the slope of the tangent plane at a particular point on the sphere was 0°, while the slope of the light source on the sphere was 10°, then the uniformity would be hurt by a factor of 1/cos 10°, approximately 1.5% if the slope of the light source was 30°, the uniformity would be hurt by 15%.

Figure 11D:
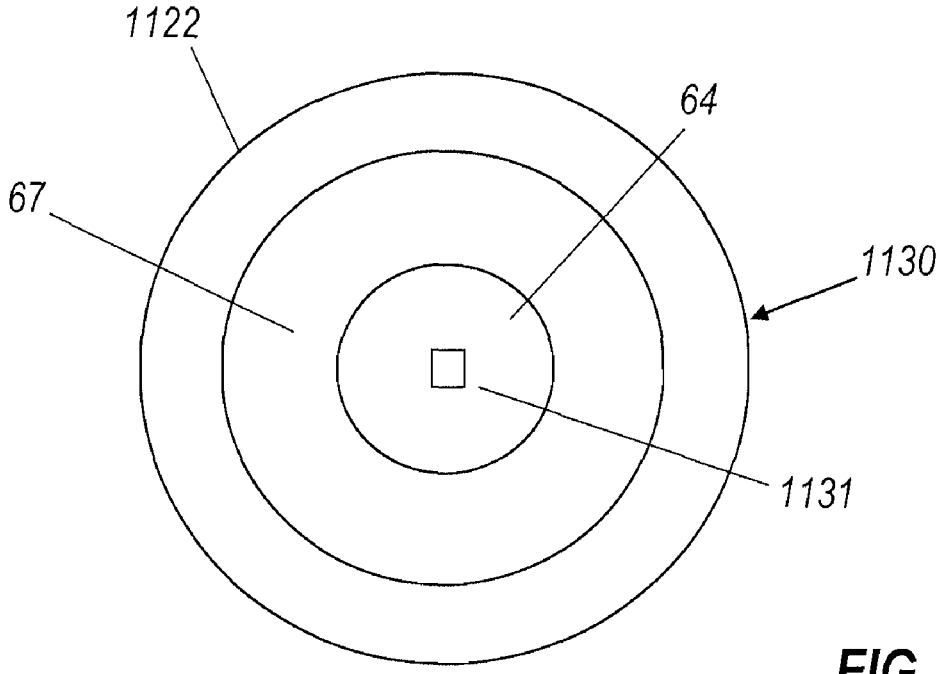
FIG. 11D shows a plan view similar to FIG. 11A, showing an alternative LED configuration with one LED.

FIG. 11D shows a plan view of a preferred embodiment of the light engine using is a single very high powered LED. Light engine 1130 has one LED 1131 mounted in the center of circuit board 64, which as before is surrounded by diffuse reflector 67. The top emitting surface of LED 1131 is very close to the tangent of imaginary extension of spherical phosphor ball 1122 (as can be seen in FIG. 11C), thereby insuring uniform illumination of the ball. An off-central-axis position can also be chosen for LED 1131 as long as its position and orientation do not deviate too much from the ideal location tangent to phosphor ball 1122 or its imaginary extension. Any of the LED positions described in the embodiment of FIGS. 11A, B and C meet this requirement, as do the LED positions and orientations described elsewhere with regard to the embodiments of this invention.

Deviation from the ideal position on the sphere also has a negative effect on uniformity. If the projected solid angle of the board 64 in FIG. 11A at a point on the phosphor sphere in the vicinity of diffuse reflector 67 is about the same as the ideal case when the board 64 is tangent to the sphere then the negative effect is tolerable. Otherwise it is not. When either the LED positions are displaced from the sphere or the LED orientations are not tangent to the sphere, the diffuse reflector cup 67 produces Lambertian scattering onto the phosphor sphere of light that otherwise would be lost. The uniformity of the scattered light from the diffuse reflector cup on the phosphor sphere in the first pass is dependent on the same conditions just discussed for the LEDs. Those skilled in the art of illumination and optical engineering will be able to determine whether deviation from the ideal position is acceptable for a given application using methods and tools of this field, such as raytracing and analytical expressions, once the principles revealed in this specification are fully understood.

Figure 7A:
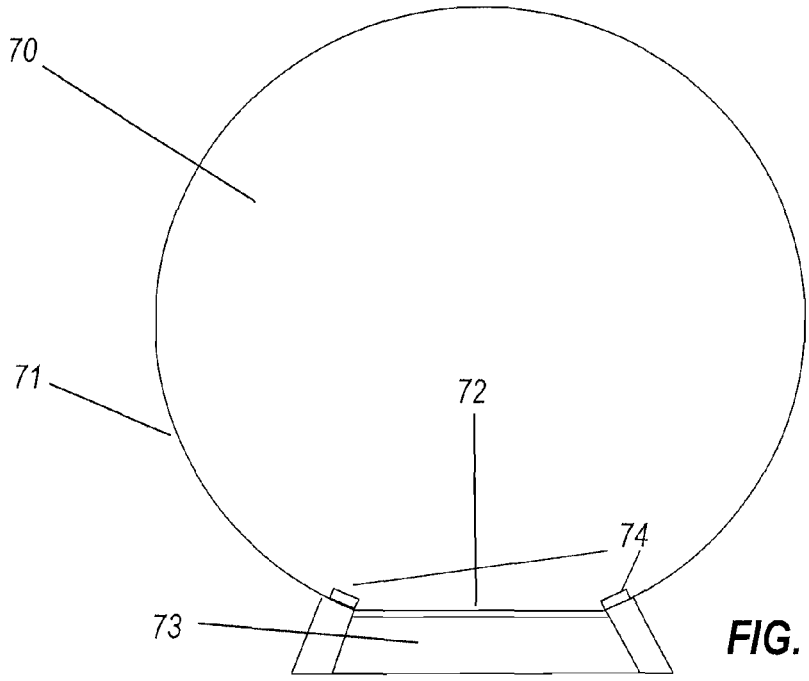
FIG. 7A is a cross-sectional side view similar to FIG. 4A of a further preferred embodiment of a light engine and spherical phosphor.

FIG. 7A shows translucent sphere 70 with phosphor coating 71, circuit board 72, base 73, and Lambertian LEDs being oriented and mounted on a conical element 74 which is a surface of revolution of a tangent or chord to the bottom of sphere 70. LEDs on element 74 uniformly illuminate spherical phosphor coating 71. Circuit board 72 is covered by a white diffuse reflector, which will produce a reflected Lambertian output from a portion of the back-scattered blue light, and back-emitted yellow coming from spherical remote phosphor coating 71. (A significant portion of the back-emitted light is sent directly to another section of spherical remote phosphor coating 71.) An interesting property of the sphere is that if the interior light from the phosphor layer is uniform and Lambertian, reflective circuit board 72 will be uniformly illuminated. Therefore, the reflected light from reflective circuit board 72 (assuming, again, that it is a Lambertian white diffusive reflector) will uniformly illuminate spherical phosphor coating 71. The process will be repeated many times, at each of which a portion of the light will be escaping through the phosphor layer and towards an outer translucent globular enclosure (not shown) similar to enclosure 13 of FIG. 2A. Such a translucent globular enclosure further homogenizes the output by diffusing the light even more, and sending some light back towards the phosphor layer 71.

Figure 7B:
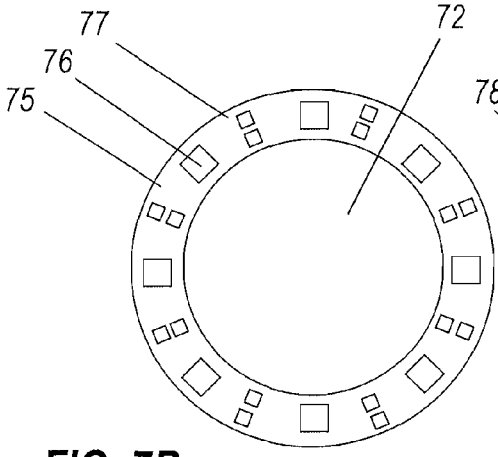
FIG. 7B is a plan view of one light engine for the device of FIG. 7A.

FIG. 7B is a plan view of the light engine of FIG. 7A, showing reflective circuit board 72 with circumambient ring 75 upon which are mounted eight blue LEDs 76 and sixteen red LEDs 77. If the diameter of circuit board 72 is relatively small compared with the diameter of sphere 70 (which will nearly be a complete sphere), LEDs 76, if they are sufficient large in size, will illuminate reflective circuit board 72 fairly evenly, which in turn will uniformly illuminate spherical phosphor ball 71. Even if, however, the light from LEDs 76 and 77 does not uniformly illuminate circuit board 72, the effect on the overall uniformity of the system is small, because the amount of light directly striking circuit board 72 is a small percentage of the light directly striking spherical phosphor 71. For example, if the full opening angle of sphere 70 is 330° then 93% of the direct light from LEDs 76 and 77 will be illuminating spherical phosphor coating 71. Thus, only 7% strikes reflective circuit board 72. (For the case of the preferred embodiment of FIG. 1, the full opening angle of the sphere is 300°, corresponding to a percentage "loss" of only 1% more, for 8% total.) Assuming the worst, this only introduces a variation in uniformity of less than 7/93, or less than ±3.75%. The value is even less if one considers the back-emitted and scattered light from the phosphor, which further reduces the variation in output.

Figure 7C:
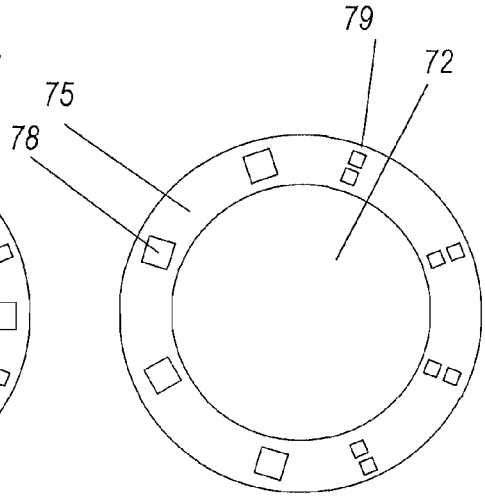
FIG. 7C is a plan view of an alternative configuration of light engine for the device of FIG. 7A with blue and red LEDs facing each other.

The circumambient ring 75, with attached LEDs 76 and 77, can be produced on a series of circuit boards connected by flex hinges lying on a flat plane, enabling the use of pick and place machines. Circumambient ring 75 may comprise tabs projecting radially from the central circuit board 72. Alternatively, the circuit boards forming ring 75 may be hinged end-to-end to form a C-shaped tessellation. Because the cone is a developable surface, this flat tessellation can be folded into a facetted conical element to be mounted on a suitably shaped heat sink. In that configuration, if circuit board 72 is not used to support printed circuitry, it may be merely a white blanking plate, or even the top of a heat sink such as frame 3, and need not be a circuit board. The number of required LEDs 76 and 77 on the ring can be less than in the aforementioned embodiments, but practical limitations in flux output may require that a similar number of LEDs be used (approximately one LED or chip every 45°). The position on the ring of the blues and reds is essentially arbitrary, however, because any source on the ring (any position on it) will uniformly illuminate spherical phosphor coating 71. Therefore, the placement tolerance for the LEDs in this system is very forgiving. An example of an asymmetric placement of LEDs is shown in plan view FIG. 7C with four blue LEDs 78 on the left portion of conical ring 75 and 8 red LEDs 79 in pairs on the right. This has some advantages if there is more heat from the blue than from the reds. By providing a thermal insulating material (not shown) to isolate the heat between the red and blue LEDs, it may be possible to lower the operating temperature of the reds, thereby gaining efficiency.

Figure 8:
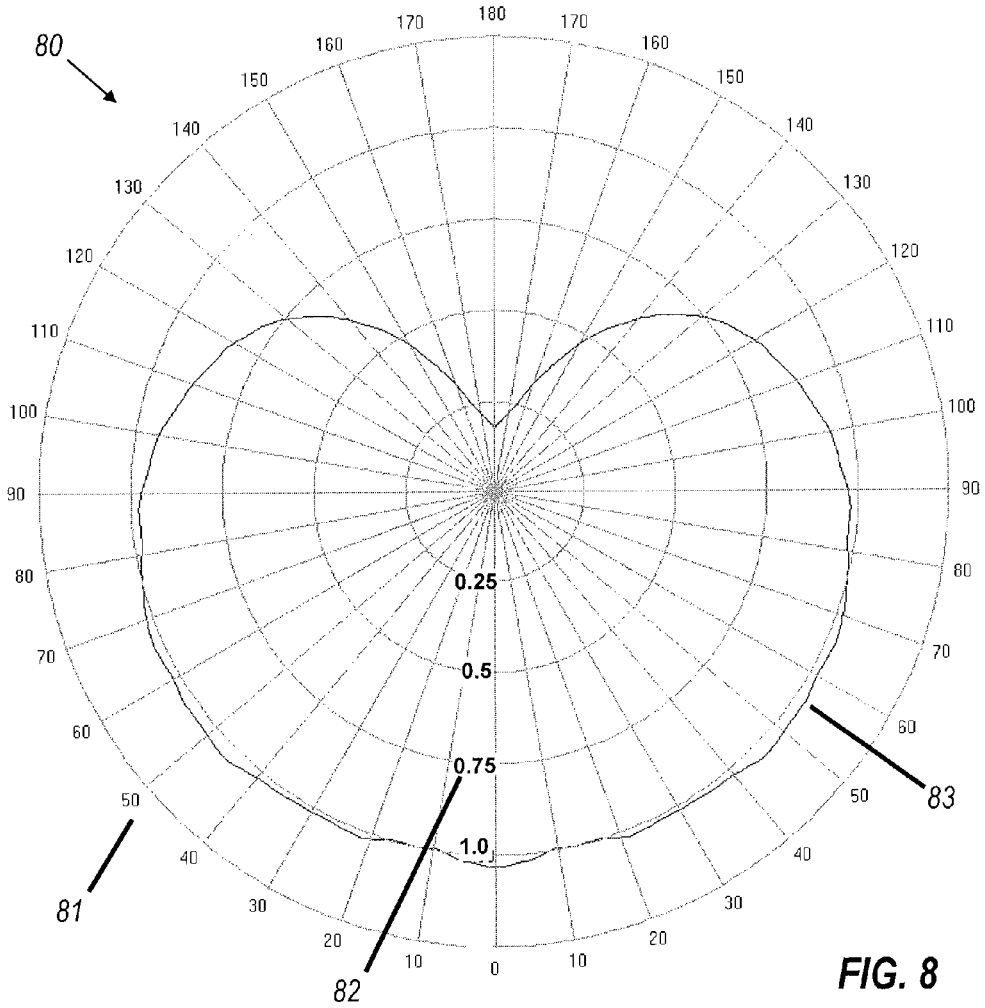
FIG. 8 shows the spherical intensity distribution of light from the LED light bulb shown in FIG. 1.

FIG. 8 shows a polar graph 80, with azimuth scale 81 and radial scale 82 of relative intensity of the preferred embodiment of FIG. 1A. Here the 180° of azimuth denotes the rearward axial direction therein, through the center of circuit board 2, 52 and Edison screw 11, 31. Graph line 83 is a result of a Monte Carlo ray-tracing simulation with approximately 1 million rays. On radial scale 82, unity denotes the average intensity, which is pulled down slightly from the forward intensity by the rearward deficit of intensity around azimuth 180°, This is a smoother pattern than actually measured for conventional light bulbs.

Figure 9:
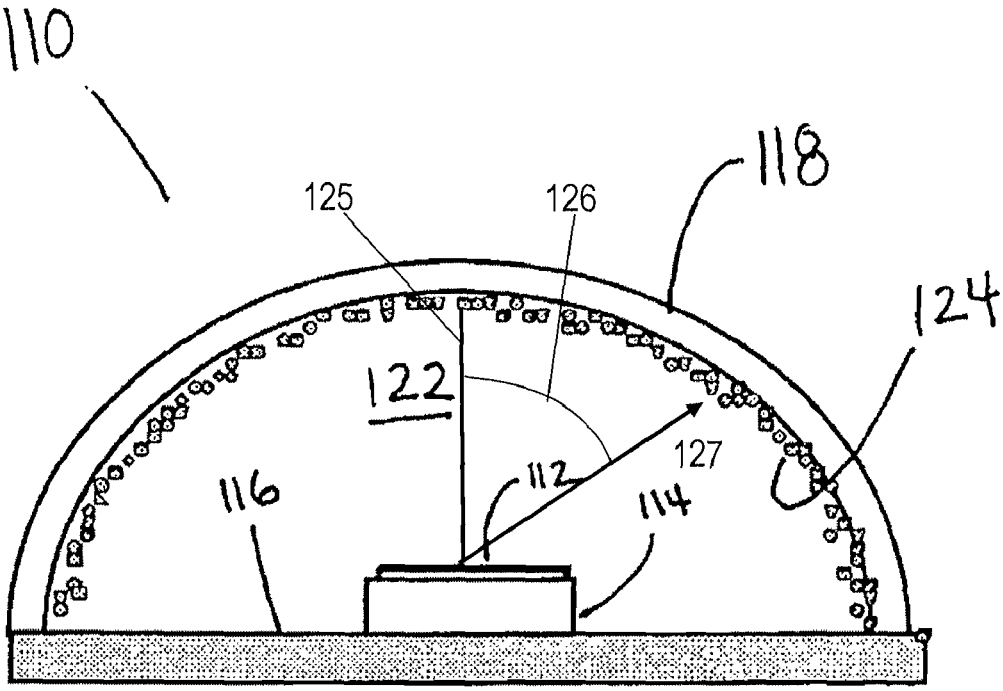
Prior Art FIG. 9
FIG. 9 shows an example of a previously disclosed hemispherical emitting white LED source of the prior art.

FIG. 9 is a copy of FIG. 2 of the above-mentioned U.S. Pat. No. 7,479,662 to Soules et al., which is an example of the prior art utilizing an LED in the center of a remote phosphor hemisphere. According to Soules et al. it has "the phosphor coated surface having a surface area about at least 10 times the surface area of the LED chip". In such a configuration, the LED can be nearly considered a point source for the preceding analysis. Subsequent reference to (three-digit) numbers and Figures are those of the Soules patent. Additional reference line 125 represents the zenith direction, additional reference arrow 127 represents intensity from LED 112, and additional angle 126 is the angle between the zenith direction 125 and intensity direction 127. As was stated before, for a Lambertian LED source which emits hemispherically, the intensity in any direction varies in proportion to the cosine of the angle with respect to the normal to the LED, which is the same as zenith direction 125. Therefore, for a Lambertian LED the intensity on the remote phosphor of this prior art will be proportional to the cosine of the angle 126. In this case the intensity goes to 0 when angle 126 is 90°. As the distance from the LED to the phosphor is approximately constant, the illuminance on remote phosphor 124 varies from a maximum in the zenith direction to 0 when angle 126 is 90° (illuminance is proportional to the intensity divided by the square of the distance from the source). Since the phosphor is not uniformly illuminated, the light back-scattered and back-emitted from the phosphor does not uniformly illuminate reflector 116. Therefore, even if reflector 116 was a diffuse white reflector (this is not mentioned in the description of FIG. 2 of Soules et al.) the light reflected off 116 would not uniformly illuminate hemispherically shaped phosphor 124. Presumably, this is why Soules et al. state that the LED must be one that has uniform output.

The embodiment of FIG. 3 (not shown herein) of Soules et al. shows a similar design to that of his FIG. 2, but in this case the reflector 216 has a reflective layer 240 (white ceramic), and on top of that a phosphor layer 224. The same analysis, however, of the prior-art embodiment of FIG. 2 in Soules et al. can be applied equally well to the embodiment of FIG. 3 of Soules et al. That is, the illuminance of the phosphor by the Lambertian LED is highly non-uniform. Therefore, the back-scattered and back-emitted light onto phosphor layer 224 will also illuminate this layer with non-uniform blue and yellow light. The system of Soules's FIG. 3 may achieve better intensity uniformity than that his FIG. 2, but still not be very good. In addition, there would likely be a significant variation in the color temperature of the light emanating from different points on the hemispheric emitting surface of the device. The present devices can overcomes the limitations of Soules et al. as they work very well with standard LEDs and do not require LEDs which produce 'uniform output'.

Figure 10:
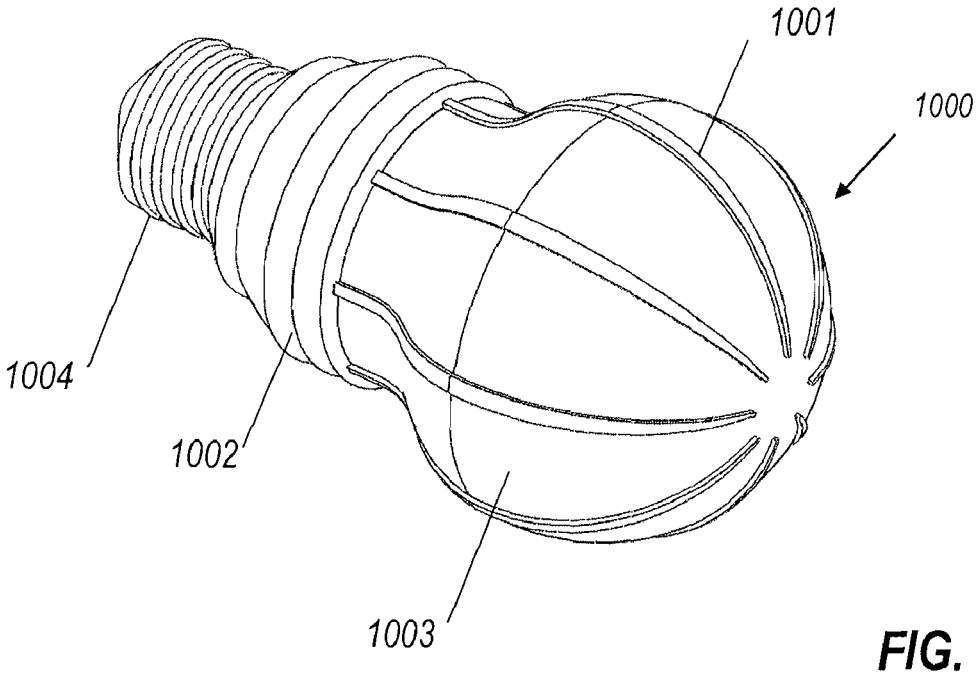
FIG. 10 shows an auxiliary thermal management approach for the LED bulb of FIG. 1.

FIG. 10 shows LED Lamp 1000 comprising an additional thermal management feature incorporated into LED Lamp of FIG. 1 and FIG. 2. Eight metal strips 1001, each 3 mm wide at their widest point, 0.8 mm thick, and stemming from the sinusoidal heat sink 1002, are conformally attached to the glass bulb 1003. Strips 1001, coated diffusive white, can be attached on the outside or inside of glass bulb 1003, or embedded within it. Strips 1001 help to evenly spread heat from the sinusoidal heat sink 1002 out over glass bulb 1003, which then dissipates the heat by conduction, convection, and radiation to the surrounding air. Glass bulb 1003 is thus turned into a part of the thermal management system. Thermal simulations using the software COSMOS were carried assuming 5 W of heat from the LEDs, 0.96 W of heat from the power supply near Edison screw base 1004, and 0.75 W of heat from the phosphor. In this case metal strips 1001 placed on the outside of glass bulb 1003 drop the LED junction temperature by 12° C. With similar strips on the inside of the bulb, the junction temperature was dropped by 10° C. Since the glass bulb is diffusive, there are no shadowing effects due to the strips. Other configurations and architectures are possible once the principle of this thermal management feature is fully understood by those who are skilled in the art of thermal engineering.

U.S. Provisional 61/264,328, already incorporated by reference in its entirety, provides information of similar thermal management systems to the one described above for LED lamp 1000. However, this co-pending application, by several of the inventors, applies to solar concentrating systems.

Various modifications are possible. For example, the bulbs shown in FIGS. 1 to 7 are based on type A19 incandescent bulbs with a medium Edison screw connector, for which countless billions of receptacles are to be found in the U.S.A. Other sizes and shapes of bulb, and other sizes, shapes, and types of connector, could be used for particular purposes or for particular geographical regions where different bulbs or connectors are standard.

For example, various arrangements of LEDs on a disk and a cone have been disclosed herein, including a disk chordal to the phosphor coated ball, and a cone frustum combined with a chordal or tangent disk. Other configurations, including a secant disk, are of course also possible. The skilled reader will understand how they may be varied and combined while still producing the desired uniform illumination and a desired color temperature. It has already been shown that a Lambertian source 31 lying on the surface of the ball 30, or a uniform Lambertian disk source (touching the edges of chord 37), will illuminate the ball 7, 30, 40, 70 uniformly. Practical arrangements of discrete sources approximating to a uniform extended source have been described. The skilled reader can calculate how much departure from the ideal uniformity case will result from a given non-uniform source, or from a given departure between the source position and the flat disk or the curve of the ball, and such minor variations are within the scope of the claims.

Placement of the LEDs on spherically curved surfaces is also possible, and may give an improvement in uniformity of illumination, although as discussed above a flat surface is more easily combined with current mass-production chip placement machinery. For the conical surfaces, it may be easiest to rotate the conical component while keeping the chip placement device fixed, or to place the chips on a flat circuit board and then bend the board to a frustoconical or frustopyramidal shape.

In the interests of simplicity, the surfaces of the ball 7, 30, 40, 70 that interface to the respective circuit boards 2, 37, 44, 54, 64, 75 have been treated as flat or smoothly curved, and the thickness of the LED chips has been ignored. In a practical embodiment, however, those surfaces of the ball may be formed with recesses to receive the LEDs, and/or a gap or gaps may be left between the circuit board and the interface surface(s) of the ball, with such recesses and/or gaps being filled with a transparent material that forms a mechanical and/or optical connection between the LEDs and the interior of the ball.

LEDs have been described as light sources, but the skilled reader will understand how the principles described may be extended to other sources of light, including sources hereafter to be developed.

In the interests of simplicity, the electrical and electronic circuitry contained in the interior space 5 of the frame 3, 32, etc. is not shown in detail. Those skilled in the art are familiar with suitable power conversion and control circuitry, and any suitable circuitry may be used. The space 5, and therefore the exterior size of the frame 3, may be made larger or smaller depending on the amount and nature of the circuitry required in a particular bulb. For example, dimming and color temperature control are possible features that the current light bulbs can provide. Temperature monitoring can be implemented to protect the LED chips from damage, by switching the lamp off or reducing the power to preclude LED over temperature.

Where the ball 7, 34, 40, 50, is hollow, the phosphor coating 8 may be applied to either the inner or the outer surface. Alternatively, the phosphor may be impregnated into a suitable material and molded into the shape of a hollow partial sphere. Dow Corning of the USA makes several injection moldable silicones that are suitable for this application, including, OE-4705, OE-6003, and XIAMETER® RBL-1510-40. Shin-Etsu of Japan and their subsidiary in the US, Shincor, also produce injection moldable silicones.

Regarding the exact material utilized for the spherical remote phosphor of the present invention, the peaked nature of the spectrum of any one phosphor species results in a highly non-uniform spectrum. The best practical output from a single color of LED and a single phosphor typically has noticeable blue and yellow peaks and a trough in the vicinity of 500 nm. It is possible to utilize a second phosphor to supply more red light. Embodiments of the present invention add to this idea with a third phosphor, a narrow band green with more spectral power close to the 500 nm spectral low. This green third phosphor more utilizes the shorter wavelengths of the blue LED. It is possible to select a red and a green phosphor that will combine with a standard yttrium-aluminum garnet (YAG) yellow phosphor to achieve a very high color-rendering index (i.e. above 90).

The following example illustrates this embodiment of the invention. Experiments were conducted using a blue LED light source with a peak excitation wavelength of approximately 450 nm. A multiple-phosphor mixture was prepared with the following composition:

Epoxy matrix: Masterbond UV 15-7, specific gravity of 1.20

And per gram of Masterbond UV 15-7 epoxy:

red phosphor (PhosphorTech buvr02, a sulfoselenide, mean particle size less than 10 microns, specific gravity of about 4): 21.1±0.03 mg.

yellow phosphor (PhosphorTech byw01a, a Ce-YAG, mean particle size 9 microns, specific gravity 4): 60.7±0.3 mg.

green phosphor (Intematix g1758, an Eu doped silicate, mean particle size 15.5 microns, specific gravity 5.11): 250.6±1.3 mg.

The key parameter is presently believed to be the percentage of the doped phosphor in the medium. The weight formula using Masterbond UV 15-7 can be corrected for other matrix materials, such as injection moldable silicones, once the density of the new material is known and compared to the density of the Masterbond epoxy.

The above composition was UV cured to a thickness of 0.73 mm, yielding the following weight per unit area for the phosphors:

| | |
|---|---|
| Red (PhosphorTech buvr02): | 1.7 ± 0.1 mg/cm$^2$; |
| Yellow (PhosphorTech byw01a): | 4.9 ± 0.1 mg/cm$^2$; |
| Green (Intematix g1758): | 20.3 ± 0.2 mg/cm$^2$. |

Figure 12:
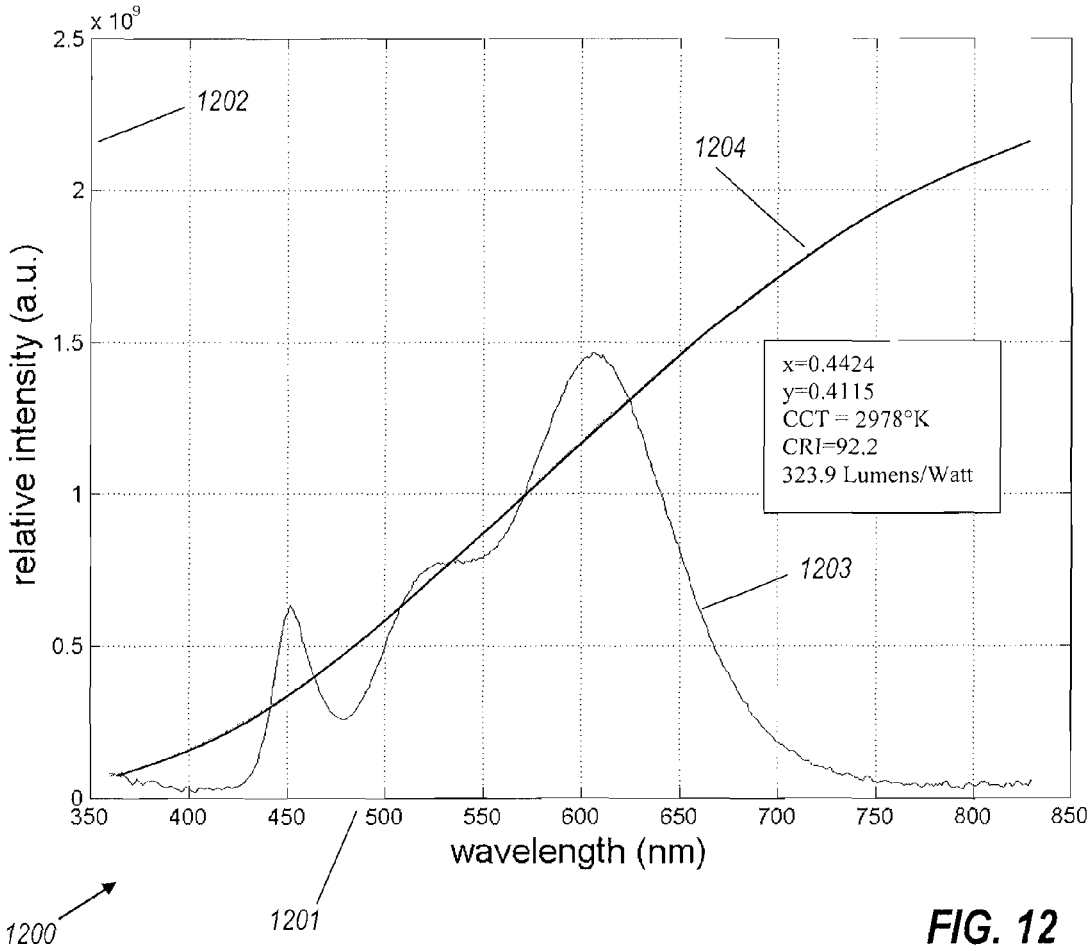
FIG. 12 shows a graph of the output spectrum of one combination of LED and a phosphor mix.

FIG. 12 shows spectral diagram 1200, with abscissa 1201 for wavelength in nanometers and ordinate 1202 for arbitrary units of spectral power per unit wavelength interval. The resultant blue-illuminated spectrum, including unconverted blue light, was as shown by curve 1203. It can be seen to follow well the smooth spectral curve 1204 of a black body at the correlated color temperature (CCT) of 2978° K, so well that the CRI is 92.2. The chromaticity coordinates (x,y)=(0.4424, 0.4115) are quite close to those of blackbody curve 1204, namely $(x_0,y_0)$=(0.4385, 0.4046), an imperceptible error of only Duv~+0.0025. Light with the spectral distribution of curve 1203 has an efficacy of 323.93 Lumens per radiant Watt. With a chip electrical efficiency of 80%, and a power-supply efficiency of 95%, the entire lamp of the present embodiment would easily exceed 200 Lumens per Watt of wall-plug efficacy.

The preceding description of the presently contemplated best mode of practicing the invention is not to be taken in a limiting sense, but is made merely for the purpose of describing and illustrating certain general principles of the invention. The full scope of the invention should be determined with reference to the Claims.

We claim:

1. A light bulb comprising:

at least one light emitting element;

a circuit board, said at least one light emitting element mounted on said circuit board;

a heat-conducting frame, said circuit board mounted on said heat-conducting frame;

a connector for attaching the light bulb electrically and mechanically to a receptacle, mounted on an opposite end of said frame from said at least one light emitting element;

a transparent ball, said transparent ball coated with a substantially uniform thickness of phosphor, said phosphor comprising a material which is photostimulated by said light-emitting element; and an interface surface occupying a minor portion of the surface of said ball, said interface surface optically bonded to said at least one light emitting element.

2. A light bulb according to claim 1, further comprising a light-permeable globular enclosure mounted on said frame so as to surround said transparent ball and said circuit board.

3. A light bulb comprising:

at least one light emitting element;

a circuit board, said at least one light emitting element mounted on said circuit board;

heat-conducting frame, said circuit board mounted on said heat-conducting frame;

a connector for attaching the light bulb electrically and mechanically to a receptacle, mounted on an opposite end of said frame from said at least one light emitting element;

a transparent ball, said transparent ball coated with a substantially uniform thickness of phosphor, said phosphor comprising a material which is photostimulated by said light-emitting element; and an interface surface occupying a minor portion of the surface of said ball, said interface surface optically bonded to said at least one light emitting element;

wherein said interface surface is in the space between a tangent to a notional continuation of the surface of said transparent ball and a chord subtending 30° half angle at the center of said transparent ball.

4. A light bulb according to claim 1, wherein said interface surface comprises at least one of a flat chord, secant, or tangent face and a cone frustum.

5. A light bulb according to claim 4, wherein said interface surface comprises said flat chord, secant, or tangent face and said cone frustum, said cone frustum encircles said flat face, and said flat face is covered with a diffusely reflective material.

6. A light bulb comprising:

at least one light emitting element;

a circuit board, said at least one light emitting element mounted on said circuit board;

a heat-conducting frame, said circuit board mounted on said heat-conducting frame;

a connector for attaching the light bulb electrically and mechanically to a receptacle, mounted on an opposite end of said frame from said at least one light emitting element;

transparent ball, said transparent ball coated with a substantially uniform thickness of phosphor, said phosphor comprising a material which is photostimulated by said light-emitting element; and an interface surface occupying a minor portion of the surface of said ball, said interface surface optically bonded to said at least one light emitting element wherein said interface surface comprises at least one of a flat chord, secant, or tangent face and a cone frustum;

wherein said interface surface comprises said flat chord, secant, or tangent face and said cone frustum, said cone frustum encircles said flat face, and said flat face is covered with a diffusely reflective material;

wherein said diffusely reflective material of said flat face is applied to said circuit board, and wherein said at least one light emitting element is mounted on a peripheral part of said circuit board, said peripheral part tangential to said transparent ball, said peripheral part optically bonded to said cone frustum of said interface surface.

7. A light bulb according to claim 1, wherein said at least one light emitting element comprises an array of blue LED chips.

8. A light bulb according to claim 7, wherein said at least one light emitting element further comprises an array of red LED chips.

9. A light bulb according to claim 8, wherein said at least one light emitting element comprises said blue LED chips interleaved with said red chips.

10. A light bulb according to claim 1, wherein said connector conforms to a standard type of receptacle.

11. A light bulb according to claim 2, wherein said enclosure is spaced from the ball.

12. A light bulb according to claim 2, wherein said light-permeable enclosure is diffusely translucent.

13. A light bulb according to claim 3, wherein said chord subtends between 15° and 30° half angle at the center of said transparent ball.

14. A light bulb according to claim 1, wherein said transparent ball is a solid ball of transparent dielectric material.

15. A light bulb according to claim 1, wherein said transparent ball is a hollow ball.

16. A light bulb according to claim 15, wherein said hollow ball is coated on its interior with said phosphor.

17. A light bulb according to claim 2, wherein said globular enclosure is glass and with metal strips, stemming from the said frame, conformally attached to the said globular enclosure either on the outside, inside, or embedded within.

18. A tight bulb according to claim 1, wherein said material of said phosphor comprises three phosphor species.

19. A light bulb according to claim 15 wherein said hollow ball is molded from a silicone material doped with said phosphor.

20. A light bulb according to claim 18 wherein said three phosphor species comprise:

for red, Phosphor Tech buvr02, at 1.7±0.1 mg per $cm^2$ of surface of said ball;

for yellow, Phosphor Tech byw01a, at 4.9±0.1 mg per $cm^2$ of surface of said ball; and for green, Intematix g1758, at 20.3±0.2 mg per $cm^2$ of surface of said ball.

21. A light bulb according to claim 3, wherein said transparent ball is a hollow ball.

22. A light bulb according to claim 21, wherein said hollow ball is molded from a silicone material doped with said phosphor.

* * * * *